United States Patent [19]

Petty et al.

[11] Patent Number: 4,850,744

[45] Date of Patent: Jul. 25, 1989

[54] SEMI-SUBMERSIBLE PLATFORM WITH ADJUSTABLE HEAVE MOTION

[75] Inventors: Terry D. Petty, Kenner; Luc G. Chabot, La Place, both of La.

[73] Assignee: Odeco, Inc., New Orleans, La.

[21] Appl. No.: 239,813

[22] Filed: Sep. 2, 1988

Related U.S. Application Data

[63] Continuation-in-part of Ser. No. 16,317, Feb. 19, 1987.

[51] Int. Cl.[4] ..... E02B 17/00

[52] U.S. Cl. ..... 405/224; 114/265; 405/195; 405/203

[58] Field of Search ..... 405/195, 203, 204, 205, 405/208, 209; 114/265, 264

[56] References Cited

U.S. PATENT DOCUMENTS

| | | | |
|---|---|---|---|
| 3,369,511 | 2/1968 | German | 114/265 X |
| 3,648,638 | 3/1972 | Blenkarn | 405/202 X |
| 4,232,625 | 11/1980 | Goren et al. | 114/264 |
| 4,457,250 | 7/1984 | Oshima et al. | 114/265 |
| 4,576,520 | 3/1986 | Suh et al. | 405/224 |
| 4,582,014 | 4/1986 | Patel | 114/265 |
| 4,646,672 | 3/1987 | Bennett et al. | 114/264 |

*Primary Examiner*—Dennis L. Taylor

*Attorney, Agent, or Firm*—Michael P. Breston

[57] ABSTRACT

The semi-submersible, deep-drafted platform includes a fully submersible lower hull, and a plurality of stabilizing columns which extend from the lower hull to an upper hull. At least one column has means adapted to reduce the water plane area within a portion of the dynamic wave zone of the column and to increase the natural heave period of the platform.

19 Claims, 7 Drawing Sheets

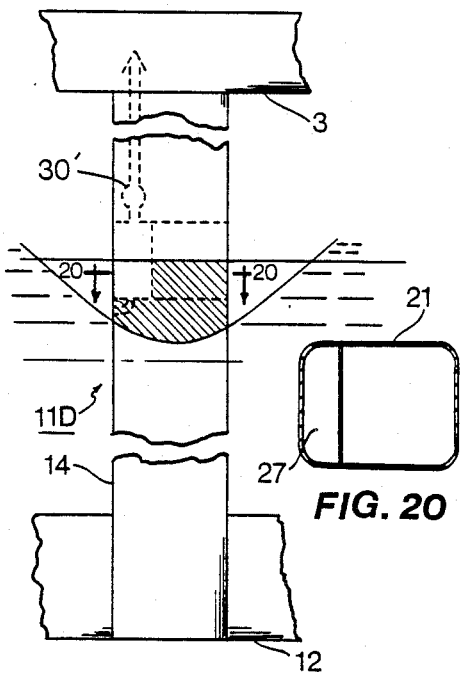
FIG. 20
FIG. 15
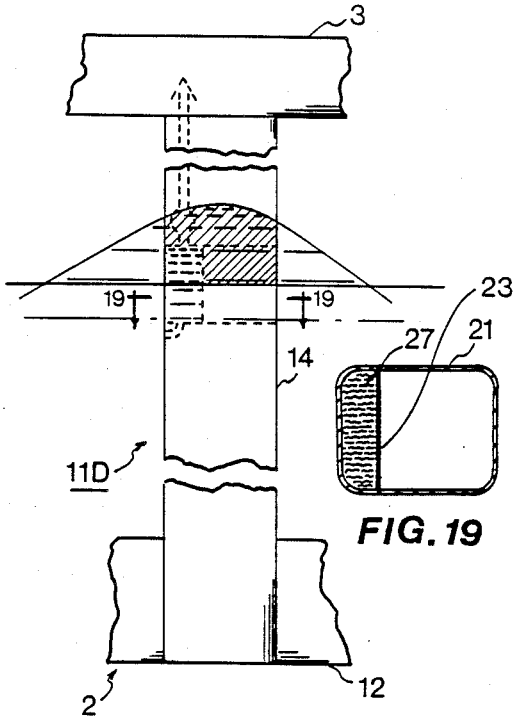
FIG. 19
FIG. 14
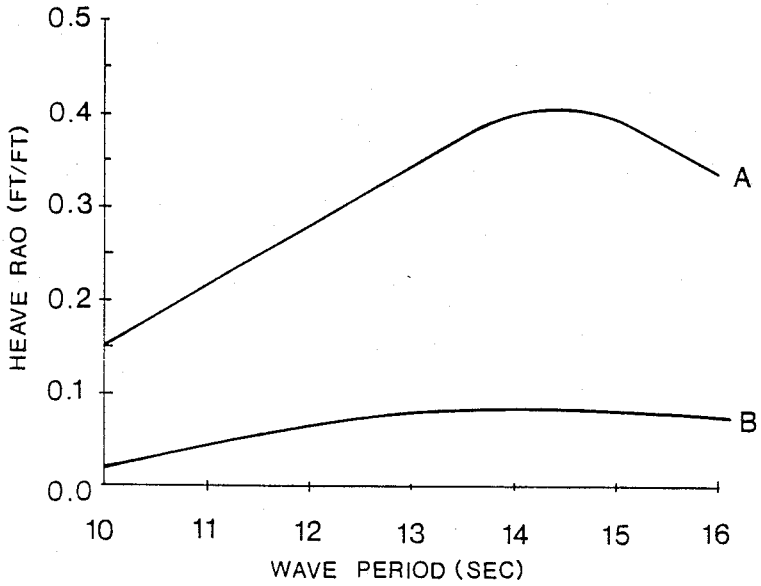
FIG. 3

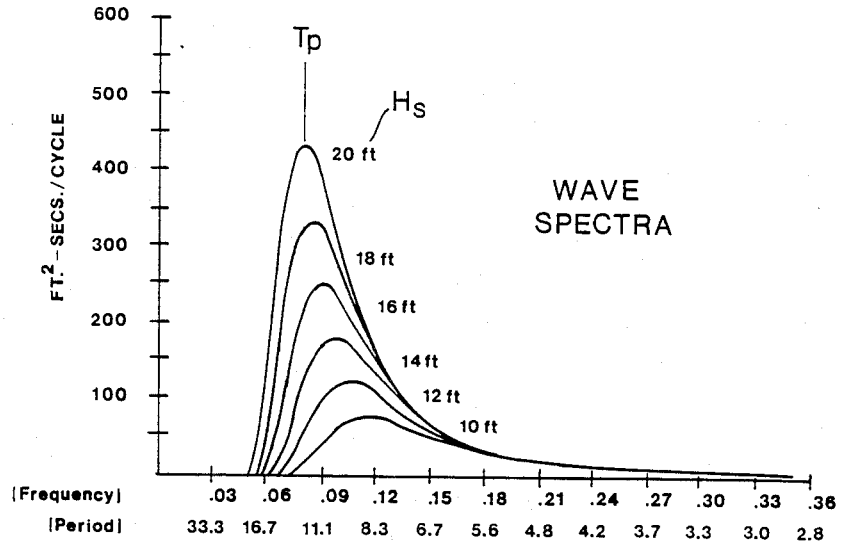
FIG. 18
FIG. 17
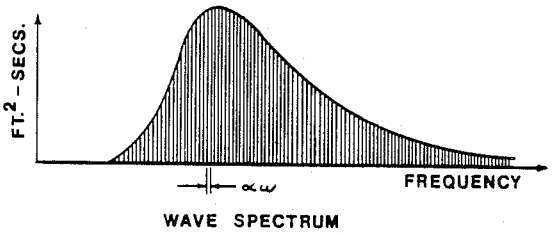
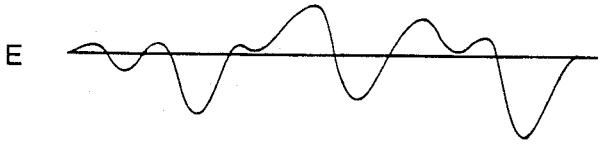
FIG. 16

SEMI-SUBMERSIBLE PLATFORM WITH ADJUSTABLE HEAVE MOTION

This application is a continuation-in-part of copending patent application Ser. No. 07/016,317, filed Feb. 19, 1987, and assigned to the same assignee.

BACKGROUND OF THE INVENTION

1. Field of the Invention

The present invention relates generally to column-stabilized floating structures and, more particularly, to a floating oil and gas production platform having an overall reduced response to the excitation waves imparted thereon by the seaways.

2. Description of the Prior Art

The worst expected seaway within a 100-year return period is used to design the platform and is commonly referred to as the "design seaway".

The parent application teaches a deep-drafted, floating platform, hereinafter called "the prior platform", for offshore hydrocarbon drilling and production operations in a design seaway.

The prior platform has a lower hull, an upper hull and stabilizing columns therebetween. In use in a seaway, a portion of each column is exposed to dynamic wave action. This portion is known as the dynamic wave zone of the column.

The prior platform has been designed to experience a low resultant vertical force in response to all waves with substantial energy in the design seaway. In use, the platform is moored on the production location by a conventional spread mooring system including winches, mooring lines, etc., for resisting horizontal motion in the seaway. By virtue of its low heave in the design seaway, a conventional, surface-type production wellhead tree is suspended from the prior platform The onboard wellheads are connected through production risers which extend the wellbores from the seabed. The platform's largest expected heave must be reduced so as to ensure structural integrity of the stiff production risers under the expected extreme environmental conditions in the design seaway.

In the prior platform, each column regardless of its exterior profile, has a constant waterplane area along the entire dynamic wave zone of the column that is exposed to wave action. Therefore, the prior platform will exhibit a constant waterplane area in all waves regardless of their amplitudes and in all seaways including the design seaway.

We have discovered that by taking advantage of the large variation in the amplitudes of the large number of component waves that make-up the design seaway, it is possible to further lower the platform's heave response by reducing the total active waterplane area of the columns within a portion of their dynamic wave zones.

Accordingly, it is a primary object of this invention to provide an improved platform which has a lower heave response in the design seaway as compared to the heave response of said prior platform.

It is an additional object of this invention to provide an improved platform which also has a lower heave response in seaways which are less severe than the extreme design seaway.

SUMMARY OF THE INVENTION

The semi-submersible, deep-drafted platform includes a fully submersible lower hull, and a plurality of stabilizing columns which extend from the lower hull to an upper hull. Each column has a dynamic wave zone in a seaway. The platform, when used in a seaway, sustains dynamic heave motion in response to unbalanced vertical forces acting on the columns and on the lower hull. At least one column of the platform has means adapted to reduce the water plane area of the column within a portion of the dynamic wave zone and to increase the natural heave period of the platform, thereby lowering the heave response of the platform to the waves in the design seaway. The means increases the platform's natural heave period to a value greater than the longest period of any wave having substantial energy in the design seaway.

The water plane area reducing means can be a channel which becomes flooded with water. The channel is adapted to reduce the water plane area within a portion of the dynamic wave zone and to increase the natural heave period of the platform.

In this manner, the platform's natural heave period remains greater than the longest period of any wave with substantial energy in the worst expected seaway.

In one embodiment, a portion of the column within the dynamic wave zone has a reduced cross-sectional area so that the column portion forms a channel on the peripheral surface of the column.

In another embodiment, a portion of the column within the dynamic wave zone has an internal channel within the interior of the column. The internal channel has an inlet means to allow seawater to freely flow into and escape from the channel, and a vent means to admit air into the channel.

The flow of water into the channel can be stopped when desired by a flow control member such as a valve. The valve can be coupled to the inlet means or to the vent means. The closing of the valve will prevent water from entering into the channel. The inlet means, the vent means, and the flow control member, when open, are designed so as to allow the surface level of the water in the internal channel to substantially follow the surface level of the water surrounding the column.

BRIEF DESCRIPTION OF THE DRAWINGS

FIG. 3 shows an enlarged portion of the RAO curve A of the semi-submersible vessel and an enlarged portion of the RAO curve B of the prior platform;

FIG. 10 shows the compartments dry and FIG. 11 shows them flooded;

FIGS. 14–15 are illustrations of the free flooding action in embodiment 11D with vent valve open; FIG. 14 shows the compartment as being filled with water under the wave's crest, and FIG. 15 shows the compartment as being drained of water under the wave's through;

FIG. 16 illustrates a randomly varying wave profile in a seaway;

FIG. 17 shows a typical energy spectrum curve of the seaway;

FIG. 18 shows energy spectra curves for seaways of varying intensities; and

FIGS. 19–20 are sectional views taken on FIGS. 14–15, respectively.

DESCRIPTION OF PREFERRED EMBODIMENTS

Prior Platform

Figure 1:
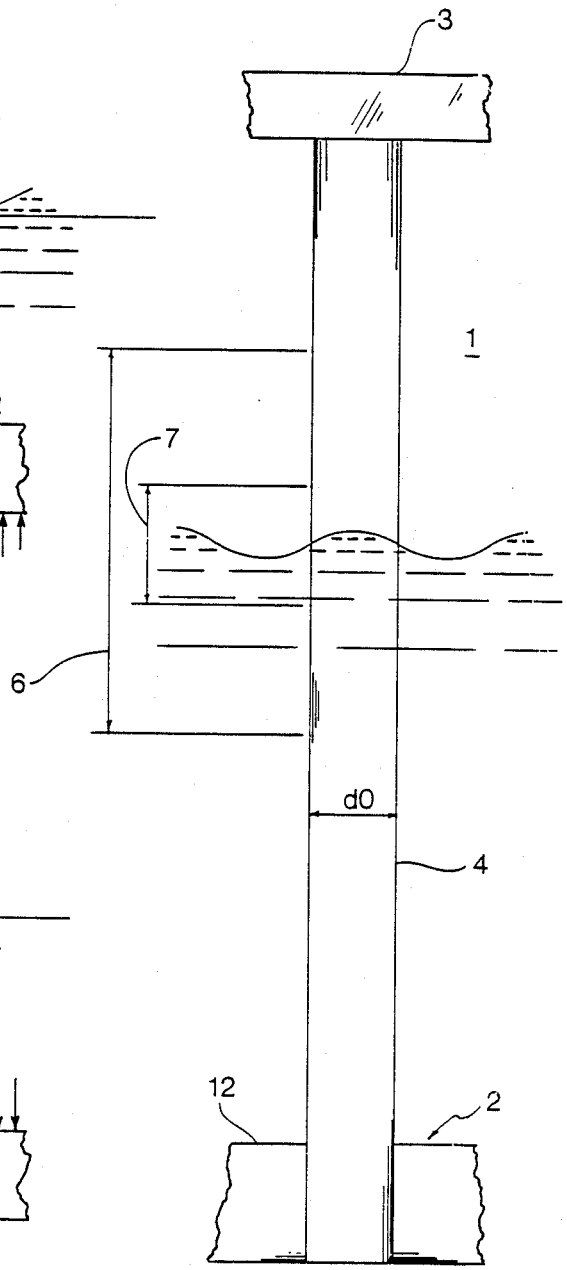
FIG. 1 is an elevational view of a single column and its upper and lower hull parts of the prior platform.
Figure 8:
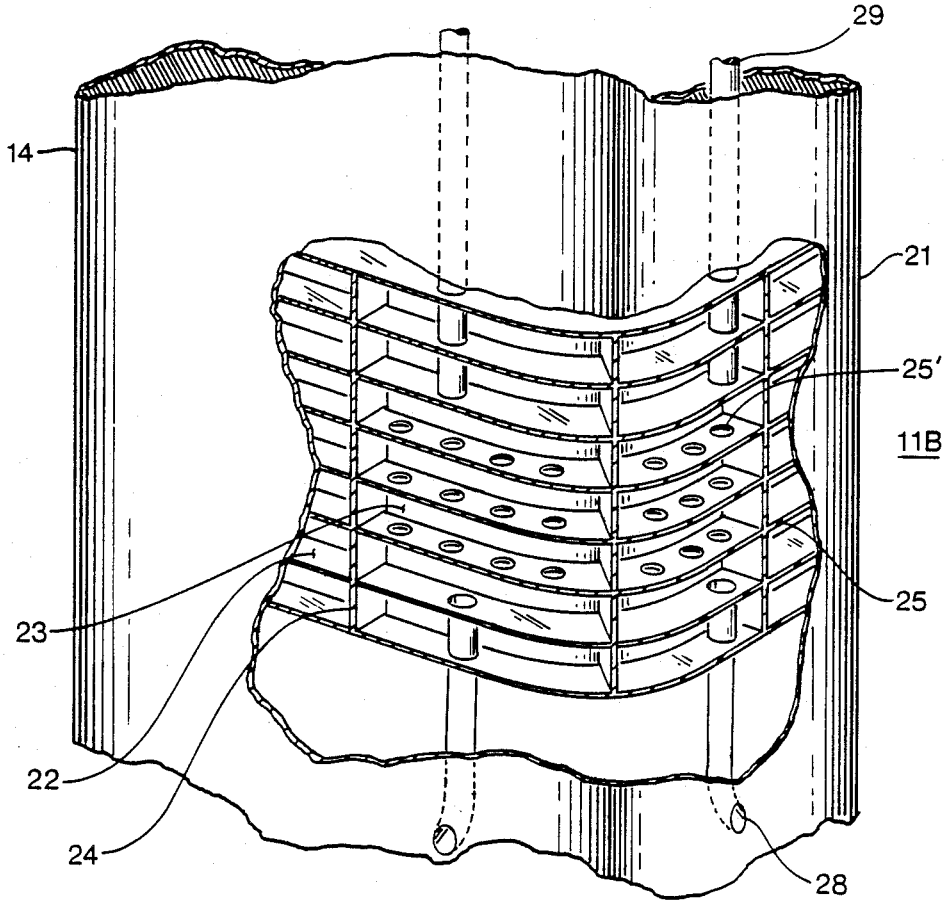
FIG. 8 is a partial perspective view of a free-flooding compartment in a column of embodiment 11B shown in FIG. 7.

The prior application describes a column-stabilized, deep-drafted, floating platform 1, schematically illustrated in FIG. 1, for offshore hydrocarbon drilling and production operations in a design seaway having relatively deep waters.

Prior platform 1 has a lower hull 2 and an above-water upper hull 3. Lower hull 2 together with large cross-section, hollow, buoyant, stabilizing vertical columns 4 support the entire weight of upper hull 3 and its maximum load at an elevation above the expected crests in the design seaway.

The vertical displacement or heave of prior platform 1 is caused by the resultant dynamic force, which is the resultant of the forces interacting on all columns 4 and on lower hull 2.

The heave response curve of the platform is commonly described by a transfer function curve called a "Response Amplitude Operator" or in short "RAO", which is the ratio of the heave amplitude divided by the amplitude of the exciting wave.

Curve A (FIG. 2) is a typical graph illustrating the heave RAO curve of a semi-submersible vessel. Curve B is a graph illustrating the RAO curve of prior platform 1.

Curves A and B are shown for the range of wave periods corresponding to dominant energy in the design seaway for the Gulf of Mexico.

Increasing the cross-sectional areas of columns 4 progressively reduces the overall heave response in the range of dominant wave energy and also reduces the natural period of resonance from $T_{n1}$ to $T_n$.

Prior platform 1 has been designed (1) to experience a low resultant vertical force or heave response to all waves with substantial energy in the design seaway, and (2) to have a natural heave period $T_n$ which is greater than the longest period of the wave with substantial energy in the design seaway. For the Gulf of Mexico, the range of such wave periods is less than 16 seconds. In this manner, it has been found that the design seaway will have insufficient energy to excite prior platform 1 at its natural period of resonance $T_n$.

Curves A and B are shown in FIG. 3 for comparison purposes. Curve A is a typical heave response of a semi-submersible vessel and Curve B is the heave response of platform 1.

The maximum heave response to a 50ft wave for a vessel having curve A would be $0.4 \times 50 = 20$ft. Curve B shows that for platform 1 the maximum heave response to a 50ft wave is significantly reduced and would be less than 5ft. Hence, platform 1 has a maximum heave which is less than 10% of the maximum wave height, i.e., an RAO of less than 0.1 for the range of wave periods corresponding to waves having substantial energy within the design seaway.

In use, each column 4 becomes partially submerged and pierces through the water surface to exhibit at that level a waterplane area 5. The portion of each column 4 that will be subjected to both water and air, due to the combined changes in water surface elevation and the vertical motion of the column, is called the "dynamic wave zone", designated by the numeral 6. In other words, the dynamic wave zone refers to the resultant active length of each column wetted by the time-varying crests and troughs of all the expected waves, and the time-varying changes in draft of column 4. The length of the dynamic wave zone 6 varies with the wave heights in the seaway. The maximum length of the dynamic wave zone is equal to the maximum dynamic wetted length of the column in the design seaway.

A portion 7 of dynamic wave zone 6 of each column, above and below the mean waterline 8, includes spaced apart inner and outer watertight skins (not shown). The annular volume between these skins is divided up by bulkheads (not shown) welded to the skins so as to form at least one watertight dry compartment, which serves to protect prior platform 1 against loss of buoyancy in the event of accidental damage to one or more columns.

In prior platform 1, each column 4, regardless of its exterior profile, has a constant waterplane area 5 along the entire portion of the column exposed to wave action, i.e., in the entire dynamic wave zone 6. Although this constant waterplane area can have different shapes, for purposes of analysis, it helps to consider this constant waterplane area 5 as having an equivalent circular waterplane area of diameter dO, hereinafter called "the reference diameter" (water plane area 5 and waterplane area dO are used herein synonymously). Therefore, prior platform 1 exhibits a constant waterplane area 5 in all waves regardless of their amplitudes and in all seaways including the design seaway.

Figure 5:
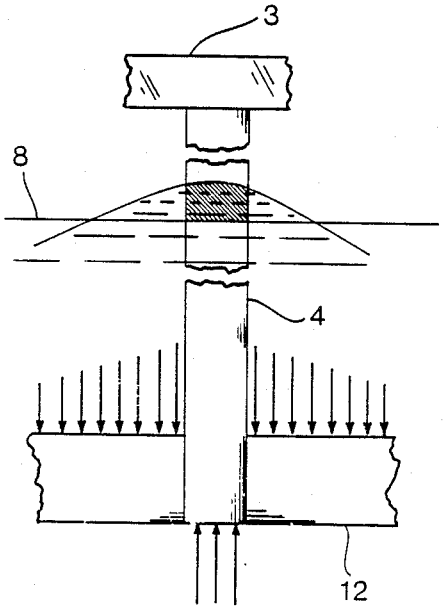
FIG. 5 is an illustration of forces acting on the column and the lower hull when in the crest of a wave.

At the wave's crest (FIG. 5), the wave surface elevation is normally above the mean water line. Consequently, the buoyant column force is in the upward direction and its magnitude varies with the column's cross-sectional area for a given wave height. The vertical column force is proportional to the column's cross sectional area.

On the other hand, the vertical component of the wave force on the submerged lower hull 2 is in the downward direction at the wave crest, and its magnitude for a given wave height varies with the volume of lower hull 2, its shape, and its draft, i.e., its distance below the wave surface.

Figure 4:
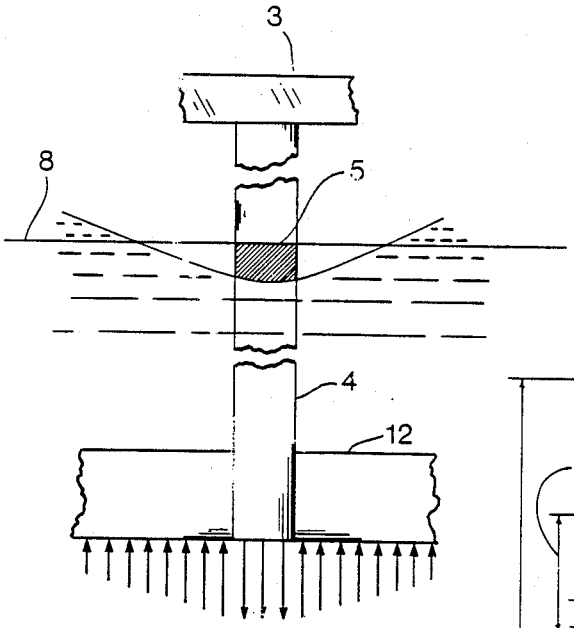
FIG. 4 is an illustration of forces acting on the column and on the lower hull when in the through of a wave.

At the wave trough (FIG. 4), the forces on columns 4 and on hull 2 are in opposite directions to the forces associated with the wave's crest. The amount of loss or gain in buoyant volume is indicated by the shaded areas.

The net or resultant force difference between the column forces and the submerged lower hull forces causes the vertical motion or heave, the angular motion or roll, and pitch to take place about the principal horizontal axes.

The amplitudes of the resultant motions are critical for maintaining the structural integrity of the stiff production risers under the expected extreme environmental conditions in the design seaway.

Improved Platform

To facilitate the understanding of the improved platform of the present invention, the same numerals will be used, whenever possible, as in prior platform 1 to designate the same parts. Similar parts may be designated with the same reference characters followed by one or more primes (') to indicate similarity of construction and/or function.

The semi-submersible, deep-drafted improved platform of this invention, generally designated as 11, is shown in four embodiments 11A–11D.

Figure 6:
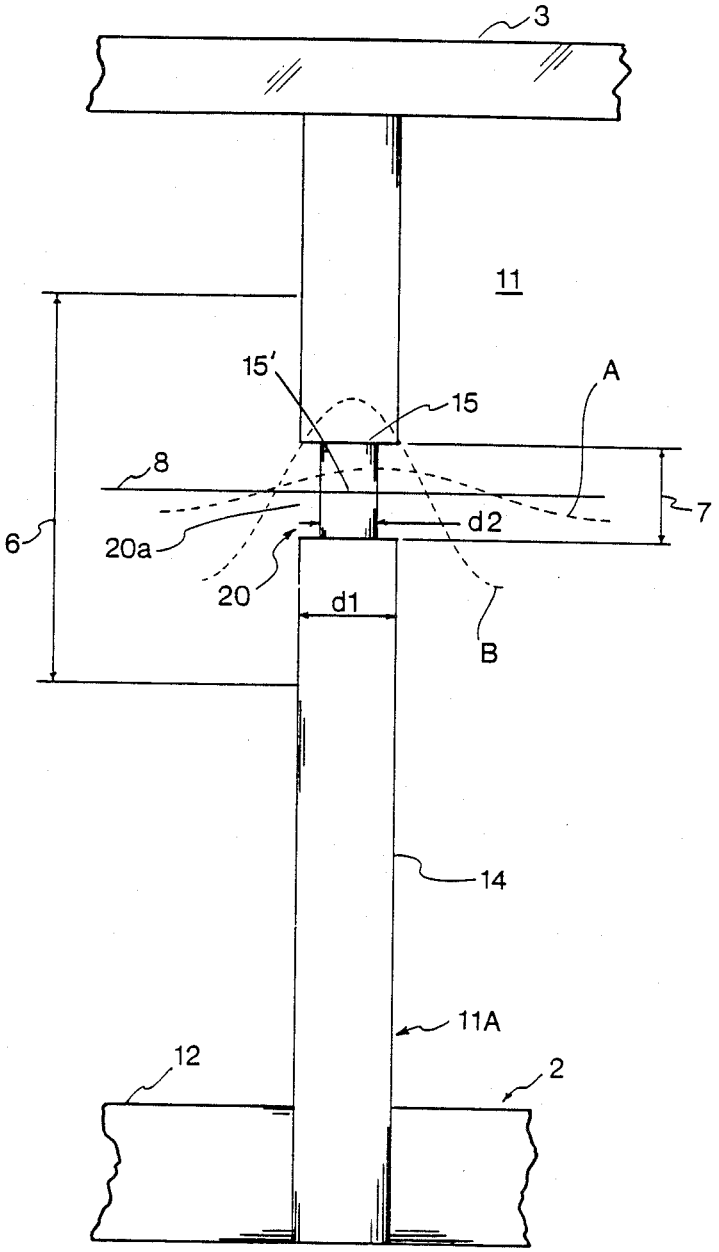
FIG. 6 is an elevational view of a single column and its upper and lower hull parts of embodiment 11A of the improved platform 11 of this invention.
Figure 7:
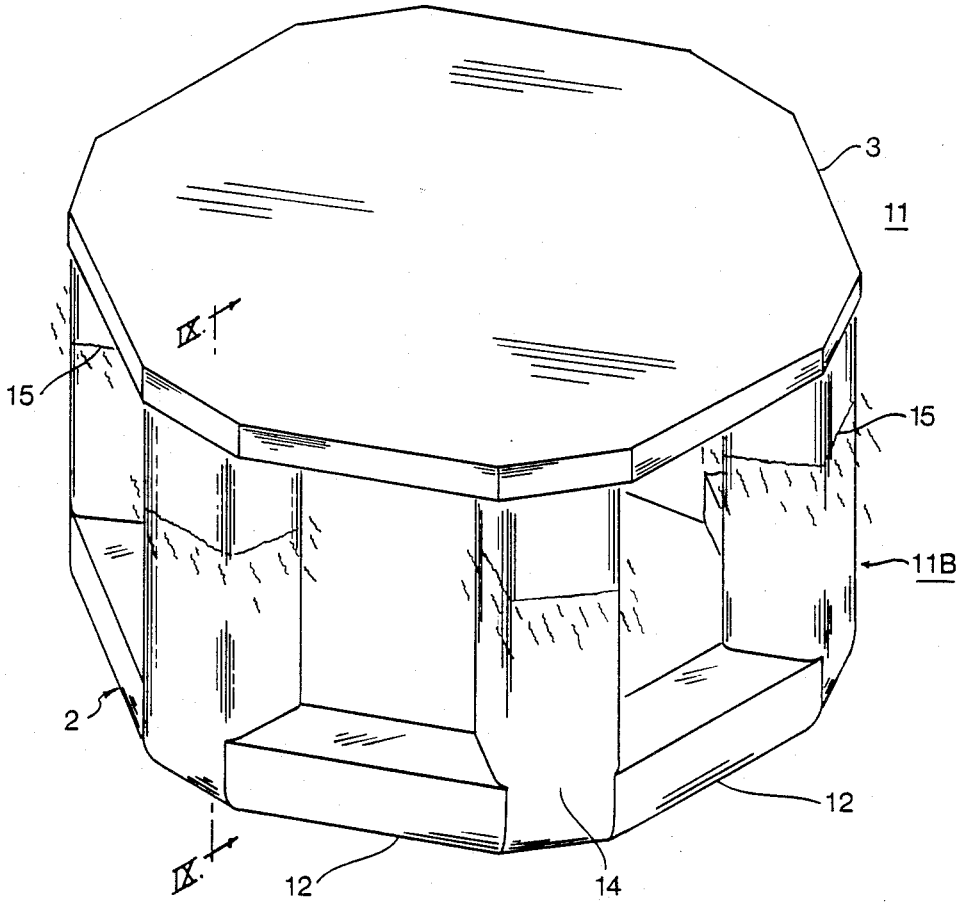
FIG. 7 is an isometric view of a second embodiment 11B of the improved platform.

Embodiment 11A of platform 11 is schematically illustrated in FIG. 6. Platform 11A comprises a fully submersible lower hull 2 and an above-water upper hull 3. Lower hull 2 is made up of a plurality of segments 12 which, together with columns 14, support the entire weight of upper hull 3 and its maximum load at an elevation above the expected crests in the design seaway.

Each column 14 has a cross-sectional area which can be expressed by an equivalent diameter d1.

At least one column 14 has a means, generally designated as 20, for reducing the column's waterplane area 15 to a waterplane area 15' within a portion 7 of the column's maximum dynamic wave zone 6, and for making improved platform 11A have a natural heave period $T_n$ (FIG. 2) greater than the longest period of the wave with substantial energy in the design seaway. Means 20 preferably extends above and below the mean waterline 8.

In embodiment 11A, the means 20 is a channel **20*a* which has a length which is equal to or larger than the length of portion 7. Channel 20*a* has the effect of reducing the cross-sectional area of column 14 along its portion 7**.

When the portion 7 of column 14 becomes partially submerged, it pierces through the water surface and exhibits at that operating draft a reduced waterplane area 15'. The remainder of column 14 outside of portion 7 has a waterplane area 15 which is larger than waterplane area 15'.

Embodiments 11B–11D

Embodiment 11B of platform 11 is shown in FIGS. 7–11. Platform 11B comprises a fully submersible lower hull 2 and an above-water upper hull 3. Lower hull 2 is made up of a plurality of segments 12 which, together with columns 14, support the entire weight of upper hull 3 and its maximum load at an elevation above the expected crests in the design seaway. Each column 14 has an equivalent diameter d1 which yields a waterplane area 15.

Columns 14 can be equally spaced apart and arranged in a generally circular configuration. The angular spacing of columns 14 on the circle, while not necessarily equal in all cases, generally provides a preferred symmetrical arrangement about the center of the circle.

One or more decks (not shown) in upper hull 3 are divided up by means of suitable bulkheads into various chambers generally used to accommodate personnel, equipment, and the like. Lower hull 2 is also divided up for ballast and storing fresh water, fuel, etc. Portions of lower hull 2 are connected to a suitable system for ballasting and deballasting its chambers when needed to submerge and raise platform 11 prior to and during mooring and towing operations.

When towed to its offshore location, lower hull 2 is ballasted with sea water until it becomes completely submerged to a desired operating depth. When a column 14 becomes partially submerged, it pierces through the water surface and exhibits at that operating draft the waterplane area 15.

Figure 2:
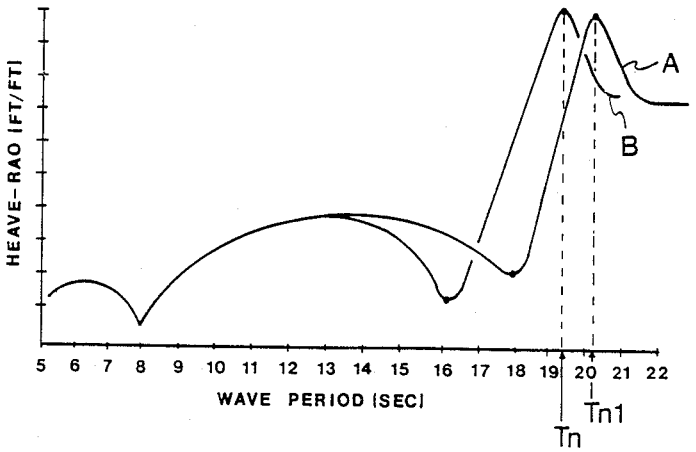
FIG. 2 shows a typical graph A illustrating the heave RAO curve of a semi-submersible vessel and a graph B illustrating the heave RAO curve of the prior platform.

At least one column 14 has the waterplane area reducing means 20 for reducing the column's waterplane area 15 within a portion 7 of the column's maximum dynamic wave zone 6, and for making improved platform 11B have a natural heave period $T_n$ greater than the longest period of the wave with substantial energy in the design seaway (FIG. 2). Means 20 preferably extends above and below the mean waterline 8.

In embodiments 11B–11D, one or more columns 14 (FIGS. 7, 10) include spaced-apart outer and inner skins 21 and 23, respectively. Regardless of its exterior profile, outer skin 21 can have a constant diameter d1 along the entire length of column 14. Diameter d1 is larger than the reference diameter dO of column 4 within prior platform 1.

Inner skin 23 has a length which is equal to or larger than the length of portion 7. Inner skin 23 is generally concentric with outer skin 21 and forms therewith an annular channel 22.

The portion of each column 14 that will be subjected to both water and air, will have a maximum dynamic wave zone 6 of about 80ft for use in the Gulf of Mexico. The 80ft dynamic wave zone 6 will be generally located symmetrically about mean waterline 8. Each column 14 will be about 240ft long. The annular channel 22 will be about 20ft long and extend on either side of mean waterline 8.

Annular channel 22 is divided up by watertight, angularly-spaced, longitudinal, bulkheads 24 and by vertically spaced, annular bulkheads 25, all welded to skins 21 and 23 so as to form therebetween at least one watertight compartment 26. The annular volume of each compartment 26 can be the same. Access to each compartment can be gained from upper hull 3 through the inner volume of column 14.

At least one column 14 (FIGS. 8–9, 11) has the waterplane area reducing means 20 for reducing the column's waterplane area 15 within a portion 7 of the column's maximum dynamic wave zone 6, and for making improved platforms 11B–11D have a natural heave period $T_n$ greater than the longest period of the wave with substantial energy in the design seaway (FIG. 2). Means 20 preferably extends above and below the mean waterline 8.

In embodiments 11B–11D, means 20 includes at least one free-flooding compartment 27. Four such compartments 27 are shown.

Each free-flooding compartment 27 has the effect of reducing the active waterplane area 15 of column 14 along its portion 7. In portion 7, column 14 has the reduced waterplane area 15' and the remainder of column 14 has the larger waterplane area 15.

For purposes of analysis, it helps to consider this reduced waterplane area 15' as having an equivalent circular waterplane area sustained by a diameter d2 that is smaller than the reference diameter dO. Desirably, at least two diametrically-opposed columns 14 have such free-flooding compartments 27. The remaining compartments 26 within each column 14 will be maintained permanently dry.

In embodiment 11B of platform 11, compartment 27 will flood automatically without operator intervention. Sea water will enter free-flooding compartment 27 by means of an opening or a suitable fill pipe 28 which is connected to the bottom annular bulkhead 25 of compartment 27. Inside compartment 27, the annular bulkheads 25 have holes 25' therein to allow water circulation therebetween. A vent pipe 29 is connected to the top annular bulkhead 25 to vent compartment 27 to the atmosphere.

Care must be taken to size the opening or the diameter of fill pipe 28 so as to allow the water level inside compartments 27 to follow closely the external sea water level. Vent pipe 29 should be sized so that the inflow and outflow of air between the atmosphere and compartments 27 are not restricted, thereby keeping the air pressure within compartments 27 roughly constant and atmospheric.

Figure 12:
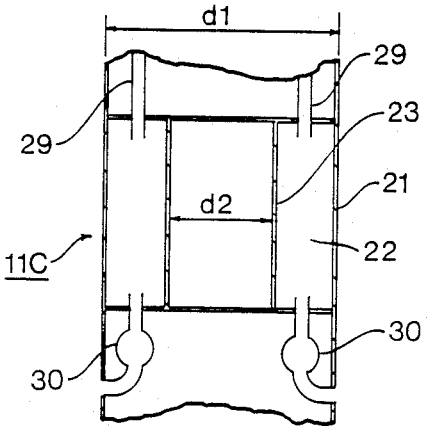
FIG. 12 is a partial elevational sectional view of a single column of embodiment 11C of the improved platform 11 of this invention.

In embodiment 11C (FIG. 12), compartment 27 will flood with operator assistance or under automatic control. Sea water will enter free-flooding compartment 27 through a flow control member such as a valve 30 in fill pipe 28. Valve 30 will control the inflow and outflow of seawater into and out of compartment 27.

Figure 13:
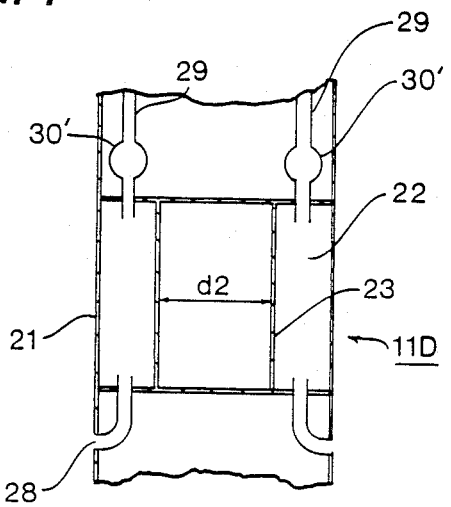
FIG. 13 is a partial elevational sectional view of a single column of embodiment 11D of the improved platform 11 of this invention.
Figure 9:
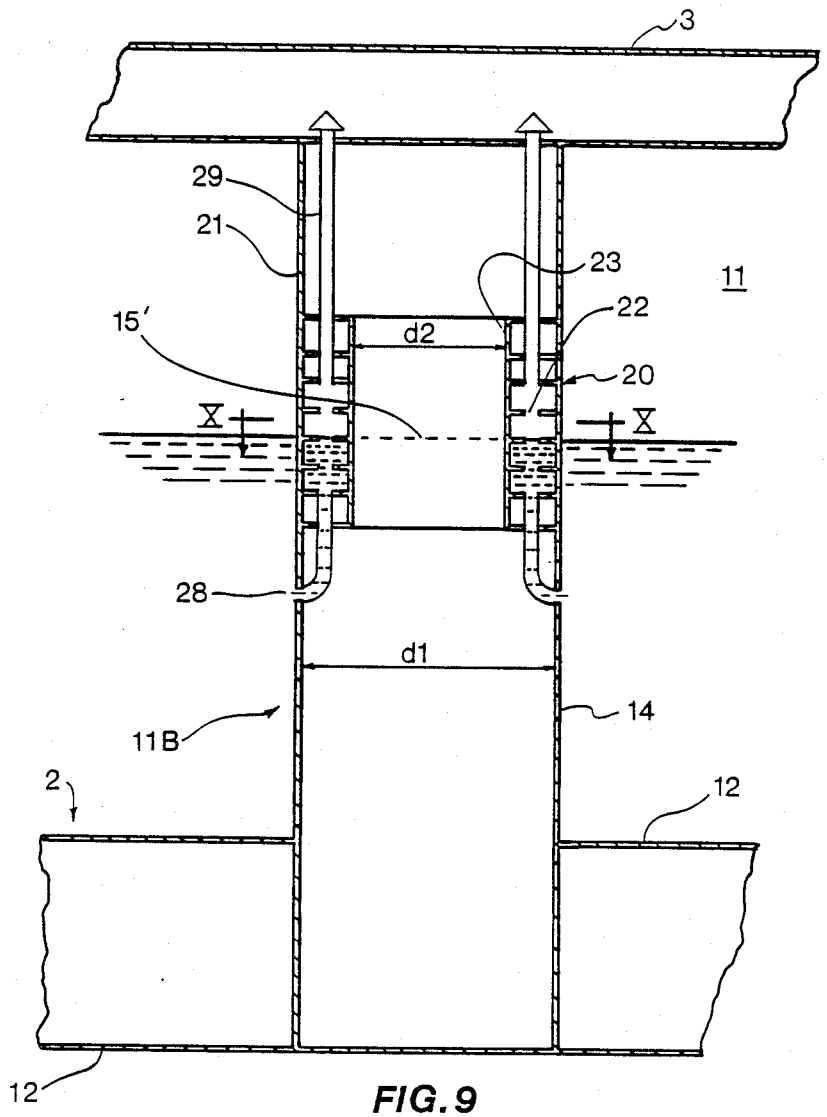
FIG. 9 is a sectional view of the column of embodiment 11B taken on line 9—9 FIG. 7.
Figure 10:
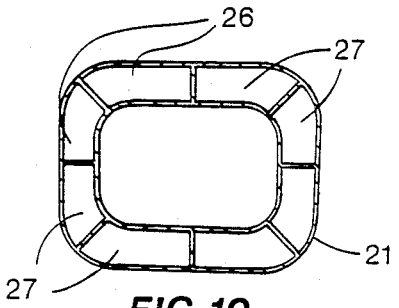
FIGS. 10—11 are horizontal transverse sectional views of the column of embodiment 11B taken on line 10—10 of FIG. 9.
Figure 11:
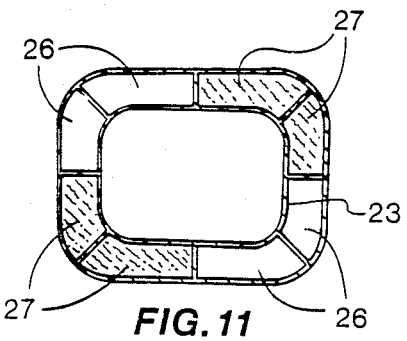

In embodiment D (FIG. 13), compartment 27 will flood with operator assistance or under automatic control. Sea water will enter free-flooding compartment 27 (FIGS. 13, 14–15, 19–20) through fill pipe 28. Air will enter compartment 27 through a flow control member such as a valve 30' in vent line 29. Valve 30' will control the inflow and outflow of air into compartment 27, thereby controlling the inflow and outflow of water through inlet 28. The amount of loss or gain in maximum buoyant volume is indicated by the shaded areas.

Valve 30 or 30' can be a ball valve, a gate valve or other suitable valve. Valve 30 or 30' can be opened in a storm as it strengthens and its energy content causes improved platform 11 to experience unduly larger heave, or the valve can be opened as a precautionary measure prior to an expected large storm.

The waterplane area reduction due to the automatically free-flooding compartment 27 of embodiment 11B is permanent, while the reduction in the waterplane area due to the controllable free-flooding compartments 27 of embodiments 11C–11D occurs only when needed or desired by opening or closing valve 30 or valve 30'.

In embodiments 11A–11B (FIGS. 6,9) and in embodiments 11C–11D (FIGS. 12–13) with valves open, the portion 7 of reduced waterplane area 15' is acted upon by the smaller-amplitude, longer-period component waves A in the design seaway (FIG. 6), and the larger waterplane area 15 outside of portion 7 is acted upon by the larger-amplitude, shorter-period component waves B within the range of dominant wave energy in the design seaway.

When subjected to the same design seaway, improved platform 11, with one or more flooded compartments 27 in embodiments 11A–11B, and in 11C–11D with valves open, has a reduced heave as compared to platform 1. This is achieved (1) by maximizing the water plane areas of columns 14 affected by the larger-amplitude, shorter-period component waves B within the range of substantial wave energy, and (2) by reducing the columns' water plane areas affected by the smaller-amplitude, longer-period component waves A falling beyond the range of substantial wave energy in the design seaway, and thereby increasing the natural period of platform 11.

The reduction in the waterplane area of column 14 in embodiments 11A–11B (FIGS. 6,9) is permanent, which results in a small increase in heave response to the less severe seaways which prevail most of the time, as compared to the heave response of prior platform 1 operating in the same seaway.

The reduction in the waterplane area of column 14 in embodiments 11C–11D (FIGS. 12–13) is controllable.

The closing of valve 30 or 30' increases the water plane area within portion 7 for all the component waves within the most frequently occurring sea states.

This results in a decrease in heave response to the less severe seaways which prevail most of the time, as compared to the heave response of prior platform 1, as well as of improved platform 11 of embodiments 11A–11B, and of 11C–11D with valves open, and all operating in the same sea states.

Accordingly, embodiments 11C–11D have a reduced heave response to the design seaway as well as to the less severe seaways.

THEORETICAL CONSIDERATIONS

A seaway is made up of a myriad of component waves all of different amplitudes, lengths and directions, originating mainly in response to wind-generated disturbances of different intensities, occurring in distinct locations, and moving in diverse directions. FIG. 16 illustrates a randomly varying wave profile in a seaway.

A realistic approach to predicting the heave of any semi-submersible platform is to describe the seaway and platform motions in terms of energy content. The intensity of the seaway is characterized by its total energy, which is distributed according to the periods or frequencies of the various wave components.

The total energy in a square foot of the seaway is equal to a constant times the sum of the squares of the amplitudes of all the component waves that exist in that seaway.

$$E_s = \tfrac{1}{8}\, mg\, (H_1^2 + H_2^2 + H_3^2 + H_4^2 + \ldots] \qquad (1)$$

where:

$E_s$ = energy in seaway $H_n$ = amplitude of wave (n)

m = mass density of water g = gravitational acceleration

Thus, the total energy of a seaway is directly related to the squares of the amplitudes of all the component waves in the seaway. This total seaway energy is known to be distributed according to the frequencies or periods of its component waves and can be plotted as a spectral density curve (FIG. 17).

Six typical spectral density curves are shown in FIG. 18. They represent a range of sea state intensities for varying significant wave heights Hs ranging from 20 ft to 10 ft, where the significant wave height is defined as the average height of the $\frac{1}{3}$ highest waves in the seaway.

The Y-axis, called the "spectral density", has units in energy-second, or $ft^2$-sec. The frequency on the X-axis has units in cycles/sec and the period has units in seconds/cycle.

As can be seen from these curves, the energy level has a peak value which occurs at a point $T_p$ which is called the peak period of the spectrum. The energy level decreases in both directions from this peak value to points beyond which no significant wave energy exists.

When platform 1 is in use and for small phase angles, the total dynamic vertical force on column 4 at wave crest is in the upward direction, as shown in FIG. 15, and its magnitude is proportional to the column's wetted volume above the mean waterline, while the vertical component of the total dynamic force on lower hull 2 is in the downward direction. The magnitude of this vertical component is proportional to the volume of hull 2 and is inversely proportional to its draft, i.e., its distance from the wave's crest.

Conversely, at the wave's trough, the total dynamic force on column 5 and the dynamic forces on lower hull 2 change in directions (FIG. 14).

For each wave frequency in the seaway, the platform's heave due to the excitation by a seaway must satisfy the following governing equation of motion:

$$(M_t\Delta M_t)\ddot{Y}+C_t\dot{Y}+K^tY=F_t(t\text{-}l) \quad (2)$$

where:

$y=yo\cos(wt+a)$ time varying heave motion
$y_o$=amplitude of heave
w=frequency of component wave
a=phase angle of heave motion
t=time in seconds
$C_t$=total equivalent damping coefficient of system
$K_t$=total equivalent spring constant of system
$M_t$=total mass of the system
$\Delta M_t$=total added or virtual mass of system
$F_t(t)$=total excitation force for heave The energy spectrum for heave is obtained from the following equation:

$$S_h(f)=RAO_h(f)^2\,S_i(f) \quad (3)$$

where:

$S_h(f)$=energy spectrum for heave
$S_i(f)$=energy spectrum for the seaway
$RAO_h(f)$=heave response amplitude operator for component wave frequency (f) and wave amplitude A(f)corresponding to spectrum $S_i(f)$.

It is also generally known that the heave amplitude of floating platforms generally follow a Raleigh type distribution. Therefore, using statistical methods, the expected amplitudes of heave, including their extreme values, can be derived from the heave spectrum $S_h(f)$.

By definition, the total heave energy is:

$$Mo_h=\int S_h(f)\,df \quad (4)$$

which is the area under the heave spectrum curve.

The average of the $\frac{1}{3}$ largest heave motions is called the "significant" heave and is calculated as:

$$h_s=4\sqrt{Mo_h} \quad (5)$$

The maximum peak-to-peak amplitude of heave expected for any given duration of the sea state, using the Raleigh distribution is:

$$h(n)=0.5\ \ln(n)\ h_s \quad (6)$$

where:

n=number of component waves encountered in the storm.

Equations 3 through 6 show that the maximum heave is proportional to the area under the heave energy curve; therefore, reducing the area under the heave energy curve will also reduce the maximum expected amplitude of heave.

Since the area under the heave energy curve for a given wave energy spectrum is also proportional to the square of the heave RAO curve, controlling the shape of the RAO curve can be used effectively to reduce the maximum heave response of the platform as predicted by Eq. 6.

A reduction in heave is achieved by the method described in said parent application whereby: (1) the RAO curve is reduced within the range of dominant wave energy by minimizing the net wave induced vertical force for component waves falling within the range of dominant wave energy during severe storms, and (2) the resonant heave period of the platform is kept beyond the range of substantial wave energy by design of the total active waterplane area and of the total mass of the platform.

The above 2 criteria can be generally satisfied using a column having a constant waterplane area of equivalent diameter d0 within the dynamic wave zone. The net effect of satisfying the above 2 criteria is to effectively reduce the area under the heave energy curve resulting from the design seaway.

A constant waterplane area is represented analytically by a constant value of $k_t$ in Eq. 2. However in embodiments 11A–11B and 11C–11D with valve 30 or 30' open, the effective value of $K_t$ is no longer constant but varies as a function of the dynamic wetted length of column 14.

Therefore, Eq. 2 can be rewritten as:

$$(M_t+M_t)y+C_ty+K_t(WL_c)y=F_t(t) \quad (7)$$

where:

$K_t(WL_c)$ varies with the dynamic length of column 14.

Firstly, in the design seaway, the smaller-amplitude, longer-period component waves act upon the region of reduced water plane area d2, thereby providing a reduction in $k_t$ of Eq. 7. The natural period of heave response is:

$$T_n=2\,(M_t+\Delta M_t)/K_t \quad (8)$$

Therefore, a reduction in $K_t$ will increase the value of $T_n$, which effectively changes the shape of the RAO curve by moving the resonant period from $T_n$ to a more desirable longer period $T_{n1}$ (FIG. 2).

Secondly, in the design seaway, the larger-amplitude, shorter-period component waves B (FIG. 6), within the range of dominant wave energy, act upon both the region of reduced water plane area d2 and on the larger water plane area d1, thereby providing an effective $k_t$ value which generally corresponds to d0, thus preserving the platform's performance for this range of wave periods.

The net result is a further reduction of the area under the heave energy curve, and a corresponding further reduction in heave in the design seaway as compared to prior platform 1 which has a waterplane area d0.

In embodiments 11C–11D (FIGS. 12–13) with valves 30 or 30' closed, $K_t$ is again constant but now $K_t$(d1) is greater than $K_t$(d0). The larger the water plane area increases the buoyant force in the less severe, but most frequently occurring sea states, thereby effecting a better cancellation of the dominant wave forces acting on lower hull 2. This cancellation reduces heave in the most frequently occurring sea states.

The resultant active length of a the dynamic wave zone 6 of a column can be obtained from:

$$WL_c(t)=s(t)-h_c(t) \quad (9)$$

$$h_c(t)=h_{cg}(t)+X_c\sin\phi,(t)+Z_c\sin\theta(t) \quad (10)$$

where:

$WL_c(t)$=time varying wetted length of a column s(t)=time varying water surface elevation $h_c(t)$=time varying change in column draft as measured from the mean water line $h_{cg}(t)$=time varying heave measured at the center of gravity (C.G.) of the platform $X_c$=distance or arm of column from C.G. in X-direction $\phi(t)$=time varying rotation about Z-axis (pitch angle)

$Z_c$=distance or arm of column from C.G. in Z-direction $\theta(t)$=time varying rotation about X-axis (roll angle).

The buoyant force acting on a column 4 in prior platform 1 having a constant waterplane area of equivalent diameter d0 is:

$$F_c(t)=mg\ V_{d0}(t), \text{ and} \quad (11)$$

$$V_{d0}(t)=0.25\pi d0^2\ WL_c(t) \quad (12)$$

where:

$V_{d0}(t)$=buoyant volume $WL_c(t)$=dynamic wetted length of column (see Eq. 9)

The maximum column buoyant force is:

$$F_c(\max)=mg\ V_{d0}(\max), \text{ and} \quad (13)$$

$$V_{d0}(\max)=0.25\pi d0^2\ WL_c(\max) \quad (14)$$

where:

$WL_c(\max)$=dynamic wetted length of the column for largest component waves with most energy $V_{d0}(\max)$=maximum buoyant volume Because column 4 exhibits a constant waterplane area within the dynamic wave zone of the design seaway, the variation in the column's buoyant force due to wave action is directly proportional to the change in the wetted length of column 4.

We have discovered that due to the variation in amplitude of the component waves that make-up the design seaway, it is possible to further lower the platform's heave response by reducing the waterplane area within a portion 7 of the dynamic wave zone 6 as a function of the amplitudes of the longer-period component waves associated with the design seaway, and by increasing the waterplane area outside of portion 7 but within the dynamic wave zone 6.

By modifying Eq. 13, the maximum column force for embodiment 11A is:

$$F'_c(\max)=mg\ V_{d1d2}(\max) \quad (15)$$

where:

$V_{d1d2}=V_{d1}+Vd_2$ $V_{d1}=0.25\pi d1^2\ WL_c(\max)$ $V_{d2}=0.25\pi WL_c(t_n)\ (d1^2-d2^2)$ d1 =equivalent large diameter of column 14 d2 =equivalent reduced diameter of column 14

$WL_c(\max)$=maximum dynamic wetted length of column $WL_c(t_n)$=dynamic wetted length of column for component wave of period $t_n$ $t_n$=natural period of heave To achieve the desired further reduction in heave in the design seaway, it is necessary that $$F'_c(\max)=F_c(\max), \text{ which means that } V_{d1d2}\max=V_{d0}(\max)$$

By modifying Eq. 13, the maximum column buoyant force in embodiments 11B and 11C–11D with valves open is:

$$F''_c(\max)=mg\ V'_{d1d2}(\max) \quad (16)$$

where:

$$V'_{d1d2}(\max)=0.25\pi d1^2\ WL_c(\max)-n_aV_a \quad (17)$$

where:

$n_a$=number of active free flooding compartments 27

$n_t$=total number of compartments 26

The volume $V_a$ of compartment 27 is:

$$V_a=0.25\pi(WL_c(t_n)/n_t)\ (d1^2-d2^2) \quad (18)$$

where:

$WL_c(t_n)$=dynamic wetted length of column 14 for component wave of period $t_n$ $t_n$=natural period of heave To achieve the desired further reduction in heave in the design seaway, it is necessary that $$F''_c(\max)=F_c(\max) \quad (19)$$

This also means that the maximum total buoyant volume of columns 14 remains equal to the base case volume $V_{d0}$ of Eq. 12 with $n_a$ valves open, or $$V'_{d1d2}(\max)=V_{d0}(\max) \quad (20)$$

The solution to equation (20) requires (1) determining $V_{d0}(\max)$ using (Eq.12), and (2) finding suitable equivalent values of d1 and d2 based on $WL_c(t_n)$ and the number ($n_a$) of compartments 27 that are permanently free-flooding in embodiment 11B, and that can be made free-flooding in embodiments 11C and 11D.

Of course, it must be understood that actual design values derived from the above general equations will be affected by the particular design seaway selected and by the motion response of the platform when in service based on its displacement, weight distribution, mooring (if used) and any other factors, devices, etc., that influence the platform's heave response.

In practice, the minimum allowable value for d2 is usually governed by the floating stability requirements of the platform.

For embodiments 11A–11B and 11C–11D with valves open, solving equations 15 or 16 for any d2 less than d0 will always yield a value of d1 greater than d0.

Therefore, for embodiments 11C–11D with valves closed, ($n_a$=0)

$$F'''_c(t)=mg\ V''_{d1d2}(t) \quad (21)$$

$$\text{ti } V''_{d1d2}(t)=0.25\pi d1^2\ WL_c(t) \quad (22)$$

Thus, $F'''_c(t)$ is greater than $F_c(t)$ which is greater than $F'(t)$ or $F''(t)$.

Hence, the buoyant column force with valves closed is always greater than the buoyant force on columns 4 of prior platform 1, and is also greater than the buoyant column force in embodiments 11A–11B and 11C–11D with valves open.

This larger buoyant column force is beneficial to provide further cancellation of the dominant wave-induced forces acting on lower hull 2, and consequently platform 11 has a reduced heave response to the smaller-amplitude component waves in all sea states less severe than the extreme design sea state.

It will be apparent that variations are possible without departing from the scope of the invention.

What is claimed is:

1. A semi-submersible, deep-drafted platform for use in a design seaway, said platform comprising:

a fully submersible lower hull;

a plurality of stabilizing columns extending from said lower hull, each column having a dynamic wave zone in said seaway;

an upper hull supported entirely by said columns;

said platform having in said seaway a dynamic heave motion response to unbalanced forces acting on said columns and on said lower hull; and at least one column having means for reducing the waterplane area of a portion of said column within said dynamic wave zone, and for increasing the natural heave period of said platform, thereby lowering the heave response of the platform to the waves in the worst expected seaway.

2. The platform according to claim 1, wherein said portion of said column has a channel, and, in use, said channel reducing said waterplane area.

3. The platform according to claim 1, wherein said portion of said column has a reduced cross-sectional area forming an external channel on the peripheral surface of said column, and said external channel, in use, reducing said waterplane area and increasing said natural heave period so that it is greater than the longest period of any wave with substantial energy in said worst expected seaway.

4. The platform according to claim 1, wherein said portion of said column has an internal channel, which, in use, becomes flooded thereby reducing said waterplane area and increasing said natural heave period so that it is greater than the longest period of any wave with substantial energy in said worst expected seaway.

5. The platform according to claim 4, wherein said internal channel having inlet means and air vent means to the atmosphere to allow seawater to freely flow into said internal channel and to freely return from said channel to the sea through said inlet means, thereby maintaining the water surface level in said internal channel at substantially the water surface level of the sea.

6. The platform according to claim 5, wherein said internal channel is disposed above and below the mean operating waterline for said platform.

7. The platform according to claim 5, wherein said natural heave period is increased so that it is greater than the longest period of any wave with substantial energy in said worst expected seaway.

8. The platform according to claim 5, wherein said column has an inner wall which together with said column's outer wall define said internal channel therebetween.

9. The platform according to claim 5, and flow control means for opening and closing said water inlet means.

10. The platform according to claim 9, wherein said flow control means, when closed, maintaining said internal channel free of water, thereby increasing the waterplane area of said column portion in less severe sea states.

11. The platform according to claim 5, and means for opening and closing said air vent means.

12. The platform according to claim 11, wherein said air vent means, when closed, maintaining said internal channel free of water, thereby increasing the waterplane area of said column portion in less severe sea states.

13. The platform according to claim 1, wherein said means is disposed above and below the mean operating waterline for said platform.

14. The platform according to claim 1, wherein said natural heave period is increased so that it is greater than the longest period of any wave with substantial energy in said worst expected seaway.

15. The semi-submersible platform according to claim 1, wherein the maximum dynamic wave zone is $WL_c$ (max), said portion of said column for component wave of period $t_n$ is $WL_c$ ($t_n$); and said $WL_c$ (max) and said $WL_c$ (tn) are obtained from Equations 7, 9 and 15 or from Equations 7, 9 and 16.

16. In a semi-submersible, deep-drafted platform including a fully submersible lower hull, and a plurality of stabilizing columns which extend from the lower hull to an upper hull, each column having a dynamic wave zone in a seaway, said platform having in said seaway a dynamic heave motion response to unbalanced forces acting on said columns and on said lower hull; the improvement wherein at least one column of the platform having means adapted to reduce the waterplane area of a portion of said column in the dynamic wave zone thereof and to increase the natural heave period of said platform, thereby lowering the heave response of said platform to the waves in the worst expected seaway.

17. The platform according to claim 16, wherein said portion of said column has a floodable channel, and, in use, said channel reducing said waterplane area.

18. The platform according to claim 17, wherein said column has an inner wall and said channel is formed between said inner wall and the external wall of said column.

19. The platform according to claim 16, wherein said portion of said column has a reduced cross-sectional area forming an external channel on the peripheral surface of said column, and said external channel, in use, reducing said waterplane area and increasing said natural heave period so that it is greater than the longest period of any wave with substantial energy in said worst expected seaway.

* * * * *